US005711366A

United States Patent [19]

Mihelich et al.

[11] Patent Number: 5,711,366

[45] Date of Patent: Jan. 27, 1998

[54] APPARATUS FOR PROCESSING CORROSIVE MOLTEN METALS

[75] Inventors: John Mihelich, Winston, Ga.; Raymond F. Decker, Ann Arbor, Mich.

[73] Assignee: Thixomat, Inc., Ann Arbor, Mich.

[21] Appl. No.: 658,945

[22] Filed: May 31, 1996

[51] Int. Cl.[6] ..... B22D 17/00; B22C 3/00

[52] U.S. Cl. ..... 164/312; 164/138; 164/900

[58] Field of Search ..... 164/900, 71.1, 164/113, 312, 316, 138

[56] References Cited

U.S. PATENT DOCUMENTS 5,333,844 8/1994 Holcombe et al. ..... 266/275

*Primary Examiner*—Kuang Y. Lin

*Attorney, Agent, or Firm*—Harness, Dickey & Pierce, P.L.C.

[57] ABSTRACT

An apparatus for processing materials which are highly corrosive while in a thixotropic state, for example aluminum. The apparatus includes a barrel which is adapted to receive the material through an inlet. In the barrel, the material is heated and subjected to shearing, forming a highly corrosive, semi-solid slurry which is discharged from the barrel through a nozzle. The barrel is constructed with an outer layer of a first material and an inner layer of an Nb-based alloy which is bonded to the outer layer. Positioned within the passageway of the barrel is a screw, the rotation of which operates to subject the material to shearing and move the material through the barrel. The screw is constructed with an outer layer of the Nb-based alloy that is molecularly bonded to an inner core of a different material. The Nb-based alloy is resistant to the corrosive effects of the material being processed.

28 Claims, 5 Drawing Sheets

APPARATUS FOR PROCESSING CORROSIVE MOLTEN METALS

BACKGROUND OF THE INVENTION

1. Field of the Invention

This invention generally relates to an apparatus and components for processing molten or semi-molten metallic materials which are abrasive, highly corrosive and erosive when in the molten or semi-molten state. One such group of metallic materials with which the present invention will have particular utility is aluminum and aluminum alloys while another group is zinc alloys containing aluminum.

2. Description of the Prior Art

Certain metals and metal alloys exhibit dendritic crystal structures at ambient temperatures and are known as being capable of converting into a thixotropic state upon the application of heat and shearing. During heating, the material is raised to and maintained at a temperature which is above its solidus temperature yet below its liquidus temperature. This results in the formation of semi-solid slurry. Shearing is applied and maintained so as to inhibit the development of dendritic shaped solid particles in the semi-solid material. As a result, the solid particles of the semi-solid slurry include what have generally been referred to as degenerate dendritic structures. Two patents, U.S. Pat. Nos. 4,694,881 and 4,694,882, which are herein incorporated by reference, disclose methods of converting metallic materials into their thixotropic semi-solid states.

U.S. Pat. No. 4,694,881 specifically discloses a process where the material, in a solid form, is first fed into an extruder and then heated to a temperature above its liquidus temperature to completely liquefy the material. The material is then cooled to a temperature less than its liquidus temperature but greater than its solidus temperature. While being cooled to a temperature below its liquidus temperature, the material is subjected to a shearing action, the rate of which is sufficient to prevent complete development of the dendritic structures on the solid particles of the semi-solid material.

The other of these two patents, U.S. Pat. No. 4,694,882, discloses a process where the material is heated to a temperature above its solidus temperature where a portion of the material forms a liquid phase in which solid particles, with dendritic structures, are suspended. The semi-solid material is then subjected to a shearing action which is sufficient to break at least a portion of the dendritic structures thereby being formed into a thixotropic state.

An apparatus for processing thixotropic materials, and particularly magnesium alloys, formed by the above two methods is disclosed in U.S. Pat. No. 5,040,589. That apparatus includes an extruder barrel in which is located a reciprocating screw. The extruder barrel is disclosed as having a bimetallic construction in which an outer shell of the barrel is of alloy 718, a high nickel alloy that provides creep strength and fatigue resistance at operating temperatures in excess of 600° C. Since the alloy 718 corrodes and erodes rapidly in the presence of magnesium at the temperatures under consideration, a high cobalt based liner is shrunk-fit into the inner surface of the alloy 718 outer shell. The high cobalt material is disclosed as being Stellite 12, manufactured by the Stoody-Doloro-Stellite Corporation and others. The screw of that apparatus is disclosed as being formed from hot worked tool steel having a suitable hard facing on its flights. No particular material is set out for the hard facing in the specification of the '589 patent. The disclosure of this patent is also incorporated by reference.

While the above construction works well for magnesium alloys, it is not suited for use with materials that are more corrosive than magnesium alloys, such as aluminum, aluminum alloys and zinc alloys, and it does not provide any guidance as to how such an apparatus might be constructed for use with more corrosive materials. When used with more corrosive materials, it is seen that the material of the liner and the facing of the screw, described above in connection with the '589 patent, are corroded and eroded by the processed material. This also results in the deposition of the processed material onto the barrel liner and screw facing, the dissolving of the liner and facing material into the processed material, and the subsequent incorporation of the dissolved material into the molded part. Obviously, this is an undesirable situation since it alters the characteristics of the material subsequently forming molded part and decreases the useful life of the extruder.

In view of the foregoing limitations and shortcomings of the prior art methods and apparatus, as well as other disadvantages not specifically mentioned above, it is apparent that there still exists a need in the art for an improved apparatus which is capable of further exploiting the molding benefits of thixotropic materials in injection molding, die casting, forging and other processes.

It is therefore a primary object of this invention to fulfil that need by providing an apparatus and components which are specifically adapted for processing materials which are highly corrosive and erosive when in a molten or semi-molten state and at the relevant temperature ranges.

It is also an object of the present invention to provide an apparatus and components which are particularly adapted for the processing of molten, semi-solid aluminum, aluminum alloys and zinc alloys.

A further object of the present invention is to provide an apparatus and components which exhibit high creep strength, erosion resistance, corrosion resistance, thermal fatigue resistance (to withstand thousands of freeze, thaw and heat to 1200° F. cycles), matched coefficients of expansion and sufficient material layer bonding to withstand the rigors of processing the above materials in a molten or semi-molten state.

SUMMARY OF THE INVENTION

Briefly described, these and other objects are accomplished according to the present invention by providing an apparatus and components which are capable of processing or conditioning the above metallic materials into a semi-solid thixotropic state. In this state, the metallic materials with which the present invention is applicable are highly corrosive and erosive and can be subsequently formed into a molded article.

The apparatus of the present invention is specifically intended to process materials which are highly corrosive and erosive while in a liquid or semi-solid state. As used in the present context, these highly corrosive materials would generally erode or dissolve construction materials at a rate greater than that of molten magnesium, in other words greater than 10 μm/hr. Representative processing materials include, without limitation, the following materials and their alloys: aluminum, aluminum alloys, zinc alloys and zinc-aluminum alloys. The remaining portions of this disclosure will only refer to aluminum or aluminum alloy as the material being processed and molded, it being understood that such references are only being made in the interest of brevity and clarity and are in no way intended to restrict or limit the scope of the present invention beyond that as set out elsewhere herein.

Generally, the apparatus and components of this invention includes a barrel which is adapted to receive the aluminum through an inlet located generally toward one end of the barrel. The material can be received in either a solid form (pellet, chip, flake, powder or other) or a molten form (liquid or semi-solid). Once in the passageway of the barrel, non-molten aluminum is heated and molten aluminum is either heated or maintained at a predetermined temperature approximately 600° C. In either situation, the processing temperature is above the material's solidus temperature and below its liquidus temperature so that the material will be in a semi-solid state when exiting the extruder.

Also while within the barrel, the aluminum is subjected to shearing. The rate of shearing is such that it is sufficient to prevent the complete formation of dendritic shaped solid particles in the semi-solid melt. This conditions the melt into its thixotropic state. The shearing action is induced by a rotating screw located within the barrel passageway and is further invigorated by a helical vane or screwflights formed on the body of the screw. Enhanced shearing is generated in the annular space between the barrel and the screwflight tips. Rotation of the screw also causes the thixotropic aluminum to generally travel from the inlet of the barrel toward the barrel's nozzle, where it is discharged. To further enhance shearing, an impeller with vanes can be used in conjunction with or in place of the screw.

In its semi-solid, thixotropic state, the aluminum is highly corrosive and erosive. Existing materials of construction, such as Stellite 12 as mentioned in connection with the prior art, exhibit high dissolution rates when exposed to molten alloys containing aluminum. Accordingly, the previously discussed device cannot be used to process aluminum. In trials, the aluminum caused the screw to weld to the barrel. By way of example, current apparatuses and methods for die casting molten aluminum use steel and ceramic shot sleeves. The shot sleeves are periodically cooled and coated in an effort to minimize the pick-up and erosion of the steel sleeve by the molten aluminum. Corrosive and erosion are limited by "cold chamber" die casting techniques which limit exposure times. These processes however have proven to be less than ideal in production situations. Ceramic materials have been used but cracking has restricted their application in components that experience high impacts.

The interior barrel environment is also a high wear environment. This is a result of the close fit between the barrel and the rotating screw as well as the shearing movement of the melt through the barrel. In addition to erosion resistance and corrosion resistance, a suitable barrel or other component must exhibit high creep strength (pressures up to 20,000 psi) and high thermal fatigue resistance (thousands of refreeze/thaw and heat to 1200° F. cycles).

Molten metal corrosion can occur by several different mechanisms. These include, without limitation, chemical dissolution, interfacial reaction, reduction, and soldering. In performing the above trials, studies were not designed to differentiate between the different mechanisms, but to obtain an approximate overall corrosion and erosion rate which could generally be expressed as a dissolution rate which needs to be withstood in order to be commercially acceptable. The actual corrosion and erosion mechanisms involved are more complex than simple dissolution. For present purposes, a high dissolution rate is defined as being greater than 10 μm/hr.

The inventors of the present invention, after significant testing and evaluation, have developed a novel extruder construction which allows highly corrosive and erosive materials, including aluminum and zinc alloys, to be conditioned into their thixotropic state without undue detriment to the extruder itself. The barrel of the extruder is constructed with an outer layer of a creep resistant first material which is lined by an inner layer of a corrosive and erosive resistant second material. Preferably, the outer layer material is alloy 718 and the inner layer is alloy Nb-30Ti-20W. More preferably, the outer layer material is alloy 909 and the inner layer is alloy Nb-30Ti-20W which has been nitrided. Bonding of the inner and outer layers is achieved by either shrink fitting or HIPPING of the components with a buffer layer between the two.

Positioned within the passageway of the barrel is a screw, the rotation of which operates to subject the material to shearing and to translate the material through the barrel. The screw is constructed with an outer layer of alloy Nb-30Ti-20W that is mechanically or physically bonded to a core layer of a material, such as tool steel, alloy 909 or alloy 718. The nominal chemical composition (wt. %) of alloy 909 is: nickel 38%; cobalt 13%; iron 42%; niobium 4.7%; titanium 1.5%; silicon 0.4%; aluminum 0.03%; and carbon 0.01%. The limiting chemical composition of alloy 718 (wt. %) is: nickel (plus cobalt) 50.00–55.00%; chromium 17.00–21.00%; iron (balance); columbium (plus tantaium) 4.75–5.50%; molybdenum 2.80–3.30%; titanium 0.65–1.15%; aluminum 0.20–0.80%; cobalt 1.00% max.; carbon 0.08% max.; manganese 0.35% max.; silicon 0.35% max.; phosphorus 0.015% max.; sulfur 0.015% max.; boron 0.006% max.; and copper 0.30% max. Preferably, the screw would have nitrided Nb-30Ti-20W over a similarly low thermal expansion alloy, such as alloy 909. This maximizes creep resistance, wear resistance and thermal fatigue resistance while minimizing debonding due to a mismatching of the coefficients of thermal expansion. Additional components of the extruder, including the extruder's nozzle, ball check, piston rings, sliding rings, seats, valve body, non-return valve and valve body, retainer, goose neck and seals, are either coated with or monolithically constructed from Nb-30Ti-20W.

Through extensive testing and development, the above construction of an extruder has been determined to permit the commercial processing of aluminum into a thixotropic state for subsequent molding, which has not been previously possible because of the above mentioned limitations.

DETAILED DESCRIPTION OF THE PREFERRED EMBODIMENT

The present invention discloses an apparatus for processing materials, herein only referred to as aluminum for reasons of clarity, which are highly corrosive and erosive while in a thixotropic state. The apparatus, seen in FIG. 1 and designated at 10, conditions molten aluminum into a thixotropic state, allowing the aluminum to be subsequently molded (injection, die casting, forging or otherwise) into an article, the particular shape of which is not relevant to the present invention.

Figure 1:
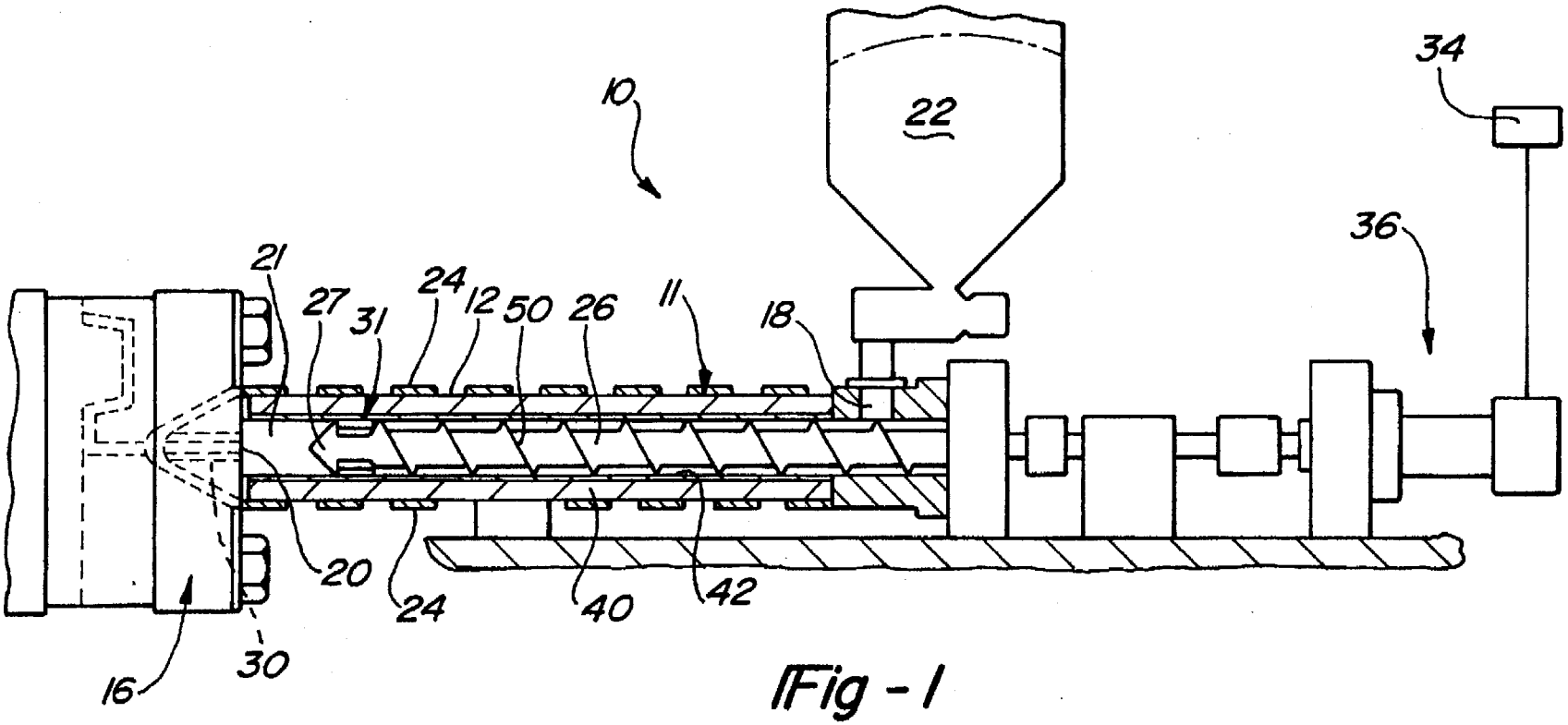
FIG. 1 is a schematic illustration of one embodiment of an apparatus for processing highly corrosive and erosive metals into a thixotropic state according to the principles of the present invention.

The apparatus 10, which is only generally shown in FIG. 1, includes a reciprocating extruder 11 having a barrel 12 coupled to a mold 16. The extruder barrel 12 includes an inlet 18 located toward one end and an outlet 20 located toward the other end. The inlet 18 is adapted to receive the metallic material from a solid particulate, pelletized or liquid metal feeder 22. Depending on the state of the metallic material as it is received in the barrel 12, heating elements 24 either heat the metallic material or maintain it at a predetermined temperature so that the material is brought into the two phase region. In this region the temperature of the material in the barrel 12 is between the solidus and liquidus temperatures of the material and, the material is in an equilibrium state having both solid and liquid phases.

A reciprocating screw 26 is positioned in the barrel 12 and is rotated by an actuator 36 to allow the vanes 50 to both move the material through the barrel 12 and to subject the material to shear. The shearing action conditions the material into a thixotropic slurry having rounded degenerate dendritic structures surrounded by a liquid phase.

Once an appropriate amount of material has collected in the fore end 21 of the barrel 12 beyond the tip 27 of the screw 26, the screw 26 will be rapidly advanced to force the material through the outlet 20 and a nozzle 30 and into the mold 16. A non-return valve 31 prevents the material from flowing rearward during advancement of the screw 26. In the mold 16', the material solidifies and the injection molded part is then removed from the mold 16.

Figure 2:
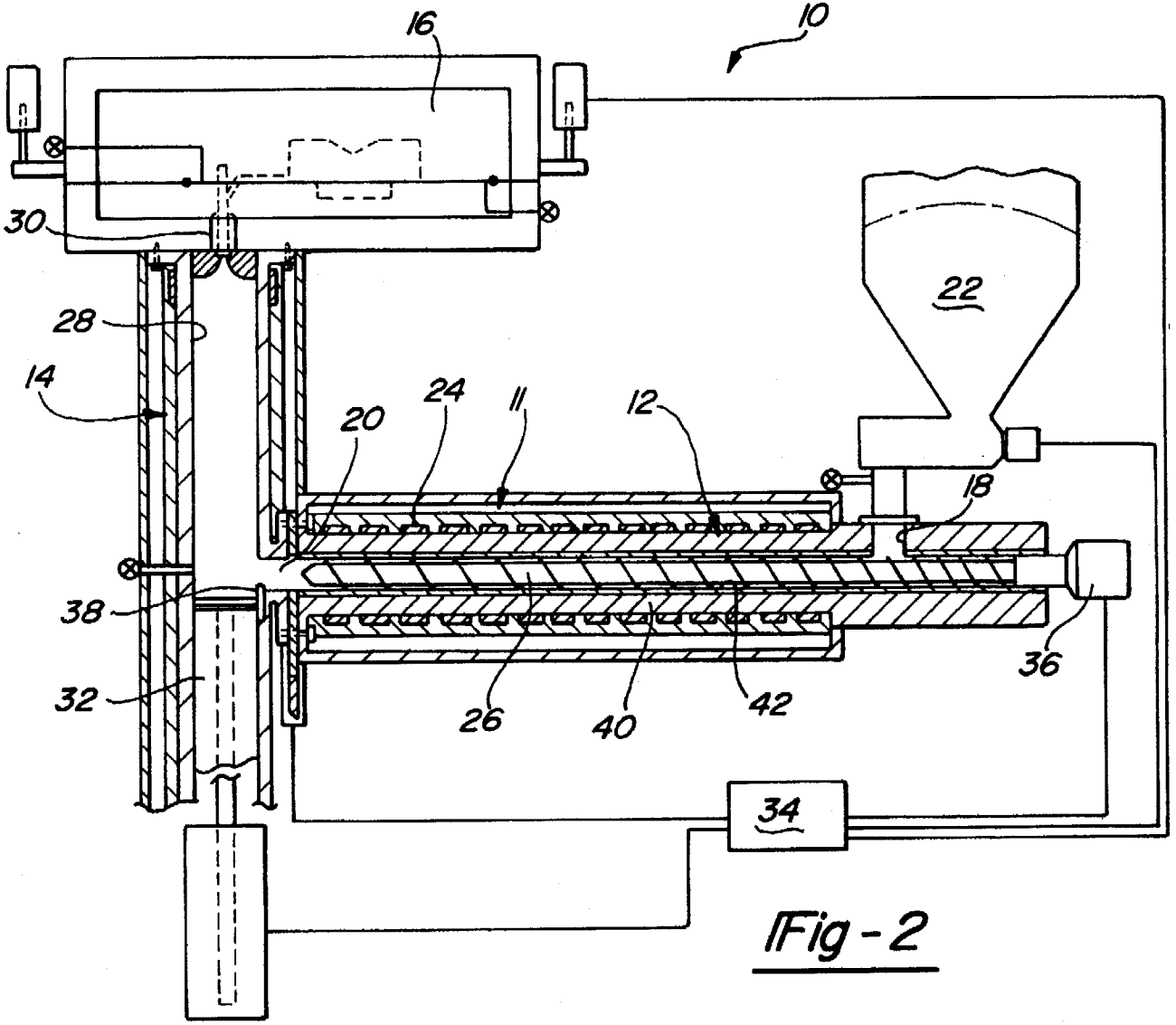
FIG. 2 is a schematic illustration of another apparatus for processing highly corrosive and erosive metallic materials into a thixotropic state according to the principles of the present invention.

A second apparatus 10', for forming die cast parts from the thixotropic slurry is seen in FIG. 2. This second apparatus 10' also includes an extruder 11' having a barrel 12' coupled to a shot sleeve 14' and further coupled to a mold 16'. The extruder barrel 12' has an inlet 18' located toward one end of the barrel 12' and an outlet 20' located at the opposing end of the barrel 12'. The inlet 18' receives the material into the barrel 12' from a solid particulate, pelletized or liquid metal source feeder 22', at a first temperature. The outlet 20' is adapted to transfer the material out of the barrel 12' at a second temperature. By establishing an appropriate thermal gradient, heating elements 24' about the barrel 12' serve to heat the material into the two phase region or alternately to cool the material to the second temperature. This second temperature is between the solidus and liquidus temperatures of the material wherein the material will be in a semi-solid state, i.e., there is a thermodynamic equilibrium between the primary alpha solid phase and the liquid phase.

A non-reciprocating extruder screw 26' is located within the barrel 12' and is rotated to move the material through the barrel 12', from the inlet 18' to the outlet 20', in manner which subjects the material to a mechanical shearing action as its temperature is being adjusted to the second temperature. The combination of these actions produces the thixotropic structure consisting of rounded degenerate dendrites surrounded by a liquid phase within the material.

The shot sleeve 14', consisting of a second barrel 28' or sleeve with an inlet passageway and an outlet nozzle 30', receives the material from the outlet 20' of the extruder barrel 12'. Mounted for axial movement within the shot sleeve 14' is a hydraulically actuated ram 32' that can be preferably accelerated at velocities of up to 200 inches per second.

In order to meter a predetermined amount of the semi-solid thixotropic slurry into the shot sleeve 14' from the extruder 11', a controller 34' is coupled to the feeder 22' and the drive mechanism 36' which rotates the extruder screw 26'. When an amount of material corresponding with the amount capable of being molded during one shot cycle of the ram 32' has been received within the shot sleeve 14', screw rotation is interrupted and the controller 34' initiates actuation of the ram 32' toward the outlet nozzle 30'.

Generally simultaneously therewith, the controller 34' also closes a valve 38' which seals the inlet into the shot sleeve 14' during movement of the ram 32'. The valve 38' prevents a backflow of the material into the extruder 11' during forward movement of the ram 32'. Additionally, the valve 38' prevents the inflow of material into the shot sleeve 28' generally behind the ram 32' when the ram 32' is located between the inlet and the outlet nozzle 30' of the shot sleeve 14'. The valve 38' may be one of a known variety of slide gate valves.

In the following discussion which details the specific construction of various components, reference will only be made to the apparatus 10 seen in FIG. 2. It will be understood, however, that the construction outlined herebelow is equally applicable to the corresponding features and components of the apparatus 10' seen in FIG. 2, where similar components have been given the (') designation. The described construction is accordingly not intended to be limited to the specific context in which it is being described and should not be so interpreted.

In arriving at the specific construction of the present invention, numerous studies were conducted to determine what materials represented likely candidates for forming the barrel 12, screw 26, valves 38, nozzle 30 and other components capable of processing a highly corrosive material. An obvious initial determination was that the construction material must have a high melting temperature and resistance to dissolution by the processed material, as well as good fabricability, strength and toughness. The initial alloys tested for dissolution in aluminum were accordingly based on Fe, Ni, Ti and Co. The general industry knowledge on the dissolution of materials by molten aluminum is minimal. Most knowledge of liquid metal corrosion and erosion is specific to corrosion and erosion by Na and Li which are sometimes used as coolants in nuclear reactors. Information on those materials is not directly applicable to molten aluminum because of differing phase relationships.

In evaluating the dissolution of the above materials, a strip of each of the proposed construction materials was used as one blade of a titanium (Ti) stirrer. The stirrer was used to agitate an aluminum alloy being maintained in its two phase region at 600° C. The stirring speed was kept constant at 200 rpm. After stirring for several hours, the strips were removed, sectioned, polished and their change in thickness determined using an optical microscope having a micrometer stage. The results of the test are set out in Table 1.

TABLE 1

Corrosion/Erosion Rates of Candidate Materials in Al alloy slurry at 600° C., 200 rpm.

| MATERIAL | CORROSION/EROSION RATE (mm/hr) |
|---|---|
| Stellite 6B (overlay on steel) | 0.20 |
| Stellite 12 (cast) | 0.17 |
| Stellite 6 (B) | 0.20 |
| Alloy 718 | 0.45 |
| Alloy 909 | 0.30 |
| Tool Steels | >0.30 |
| Ti-6Al-4V | 0.002–0.020 |
| Ti-6Al-2Sn-4Zr-2Mo | 0.012–0.045 |
| Hexalloy SA SiC | <0.001 |
| WC | <0.001 |

As indicated by the test results, the Ti-based alloys gave the lowest dissolution rates. All of the alloys appeared to have formed interfacial reaction layers, aluminide layers, on their surfaces. Since aluminum forms stable compounds with many metals, this could have been expected. After the formation of the aluminide layer, a reduced dissolution rate would be determined by the dissolution of the aluminide. From this it was determined that an aluminide having a low dissolution in aluminum would survive longer exposure times.

The respective binary phase diagrams of elements with aluminum were used to arrive at an initial indication of solubility in aluminum. Since the formation of eutectics implies a reduction in free energy of the liquid when the solute is dissolved in liquid aluminum, this increases the tendency of the solute to dissolve. Examples of the eutectic formers are Fe, Ni, Cu and Co. The opposite effect, an increase in the free energy with dissolution, is implied by the formation of peritectics. This means the temperature must be raised to dissolve the element or its aluminide. Peritectics formers, such as Ti, Nb, V, Zr and W were therefore expected by the present inventors to be more resistant to dissolution by molten aluminum than the above eutectic formers. This was further supported by the test results.

A Nb-based alloy having a nominal composition of Nb-30Ti-20W is a commercially available alloy marketed under the name TRIBOCOR 532 by Surface Engineering, North Chicago, Ill. Since all of the alloying elements in this Nb-alloy form peritectics with aluminum, this alloy was further investigated.

Many ceramics have an excellent dissolution resistance to molten aluminum. In terms of toughness and wear, the performance of ceramics improves if they are free of porosity and elemental Si. Where porosity is present, the ceramic composites of $TiB_2$ and SiC were found to be infiltrated by aluminum during initial tests. Infiltration usually occurs through pre-existing interconnected porosity. Where the ceramic materials were pore free but contained free Si, the Si dissolved during the test and allowed aluminum to infiltrate. Thermal cycling, repeated freeze and thaw of the infiltrated aluminum, will over time promote crack formation in the ceramic material and ultimately destroy the ceramic material. Infiltration of a ceramic material should therefore be avoided at all costs and the ceramic material should also be free of any interconnected phases which might readily dissolve in aluminum. Hexalloy Sa, manufactured by Carborundum Corp., Niagara Falls, N.Y., a pore free and Si-free grade of SiC, is one such ceramic material.

WC cermets were also found to have low dissolution rates in molten aluminum. However, the common binders for WC cermets, Co and Ni, have poorer dissolution resistance than Ti as seen above. If peritectic forming binders such as Ti, Nb, Zr and W (all having greater resistances to aluminum dissolution) were used, the performance of WC cermets could possibly be improved. Cermets are, unfortunately, costly, low on toughness and fabricability. Commercially, WC cermets are not bonded with peritectic formers. Both ceramics and cermets lack the toughness needed to resist cracking in the rigorous thermal and mechanical shock environment within the processing apparatus.

Because of the corrosiveness of the molten aluminum environment, any Fe, Ni or Co metallic alloy so used should be surface coated or treated to increase its life. Ceramic coatings would probably prove to be impractical because of the thermal cycling and cracking. Common wear items, such as cutting tools, are generally coated with TiC or TiN and these were considered. Carbides and nitrides of the other metals mentioned above could be viable alternatives to TiC and TiN.

Since the material selected for constructing the barrel 12, screw 26 and other components of the present invention must possesses good fabricability in addition to good strength, toughness and wear resistance at the operating temperatures, ceramics and cermets, even though having good dissolution rates, were concluded not be suitable materials for the large components of the present invention. Other components, including non-return valves, sliding gate valves and other small parts, with generally simple geometric shapes and used in contexts where cracking of the component is not a concern, the cermets and ceramics are concluded to be potential materials.

From the above initial dissolution test, it was found that Ti-alloys and Nb-alloys appear to offer the best potential as a construction material for the apparatus of the present invention. Further testing on alloys of these types were then conducted.

Various Ti-alloys were acquired for testing and some of these Ti-alloys were subjected to a tiodising treatment, which is similar to anodising for aluminum alloys. The Nb-alloy was TRIBOCORE 532, as mentioned above, and samples of this material were supplied from the above mentioned supplier with two different surface treatments, N and CN (respectively nitrided and carbo-nitrided surface treatments). Before further dissolution testing, the Ti and Nb-alloys were examined to ensure that the various samples were in fact surface treated.

In one experiment a 45 Nb-Ti alloy was used as a stirring rod, immersed in aluminum alloy 356/601 at 625° C. and stirred for 12 hours at 205 rpm. This rod was quite resistant to aluminum, but did exhibit patches high in Si from Si attack of the 45 Nb-Ti.

In additional testing the Ti and Nb-alloys for dissolution rates, a test setup as previously disclosed was employed and the materials were stirred for a period of eleven hours. The results of this testing as well as the specifics regarding each of the tested alloys is presented in Table 2.

TABLE 2

Corrosion/Erosion Rate Eleven Hour Testing of Ti and Nb-alloys.

| Material | Dissolution Rate (μm/hr) |
|---|---|
| Ti-6Al-4V (Cast) | 23 |
| Ti-6Al-4V (Cast Tiodised) | 20 |

TABLE 2-continued

Corrosion/Erosion Rate Eleven Hour Testing of Ti and Nb-alloys.

| Material | Dissolution Rate (μm/hr) |
|---|---|
| Ti-6Al-4V (Extruded) | 25 |
| Ti-6Al-4V (Extruded) Tiodised | 24 |
| Ti-6Al-2Sn-4Zr-2Mo (Cast) | 28 |
| Ti-6Al-2Sn-4Zr-2Mo (Cast) Tiodised | 24 |
| Ti-0.2 Pd (Extruded) | 14 |
| Ti-0.2 Pd (Extruded) Tiodised | 16 |
| Tribocor 532 N | 6 |
| Tribocor 532 CN | 6 |

By examining the microstructures of the samples after the test, it was revealed that all of the Ti samples formed an aluminide layer when exposed to the aluminum melt. The thickness of the aluminide layer varied between 30 μm and 60 μm at different locations and between the different alloys. An oxide layer was not present even in the tiodised samples and it was therefore concluded that tiodising does not improve the protective layer against attack by molten aluminum. The microstructure of the Nb-alloys remained unchanged near the surface after exposure to molten aluminum. The exposure to molten aluminum therefore did not result in the formation of an aluminide layer on the Nb-alloys. From the test, it can be seen that: the Nb-alloys gave dissolution rates substantially lower than the Ti-alloys; the dissolution rates of tiodised Ti-alloys were similar to the corresponding untiodised Ti-alloys; the Ti-Pd alloy exhibited the lowest dissolution rate for the Ti-alloys; and the two different surface treatments of the Nb-alloys yielded no significant difference in dissolution rates.

In addition to showing that the surface treated Nb-alloy was superior to the Ti-alloy in resisting dissolution by molten aluminum, it is noted that the bulk hardness of the Nb-alloys is approximately 600 HV (50 kg) compared to approximately 300 HV (50 Kg) for the Ti-alloys. In a combined wear-dissolution situation, the relative bulk hardnesses result in the Nb-alloys out performing the Ti-alloys. Furthermore, if the aluminide layer which formed on the Ti-alloys is continuously removed by wear, the dissolution rates of the Ti-alloys would increase over time during use of the apparatus.

In comparing the effect of the present apparatus's operating temperatures on the different alloys, the absolute melting temperatures of the base metals were used as a guide. For Nb this is 2740K and for Ti this is 1950K. The operating temperature of the apparatus 10 of the present invention is approximately 900K and this is 33% of the absolute melting temperature for Nb and 46% for the absolute melting temperature of Ti. From this it was concluded that the Nb based alloy will be mechanically and macrostructural more stable than a Ti-alloy at the relevant operating temperatures.

While the above tests yielded an alloy which was heretofore not known to exhibit a good dissolution resistance to molten aluminum, it remained to be seen whether or not an apparatus 10 constructed according to the present invention could be constructed from this material.

In attempting to fabricate a full size barrel according to the present invention and utilizing the Nb-alloy mentioned above, a barrel 12 was constructed with an outer portion or layer 40 of alloy 718. The outer layer 14 was 76 inches long, 7 inches in outer diameter, and 2½ inches in inner diameter. An Nb-based alloy liner or layer 42 having a thickness of at least 0.2 inches is desired. Because of the significantly different coefficients of expansion between the Nb-based alloy (about 5° F.) and alloy 718 (about 8.3° F.), it was thought that shrink fitting the liner 42 within the inner diameter of the outer portion 14 would prove impractical.

With no guidance being provided by the relevant art regarding the processing of aluminum, an attempt was made to HIP bond a 0.2 inch, Nb-based alloy inner layer 42 or liner directly to the inner diameter of the outer layer 14. Direct bonding of the inner layer 16 to the outer layer 14 of alloy 718 failed to produce an acceptable adhesion at the material interface. This was due to formation of different phases at the diffusion interface. Inserting a bonding layer 44 between the Nb-based alloy and the alloy 718 followed by HIPPING was then attempted to enhance the metallurgical bond and provide a transition for thermal expansion between the materials. This bonding layer 44 initially consisted of 1026 steel (0.26 carbon) having a thickness of about 0.10 inches. Failure occurred at the Nb-based alloy/steel interface due to brittle TiC, with the carbon coming from the steel. A further attempt at HIP bonding an Nb-based alloy layer 42 to the inner diameter of the outer layer 40 utilized a lower carbon steel, 1010 steel (0.10 carbon), as the bonding layer 44. This resulted in the Nb-based alloy layer 42 being satisfactorily bonded to the alloy 718 outer layer 40.

Figure 3:
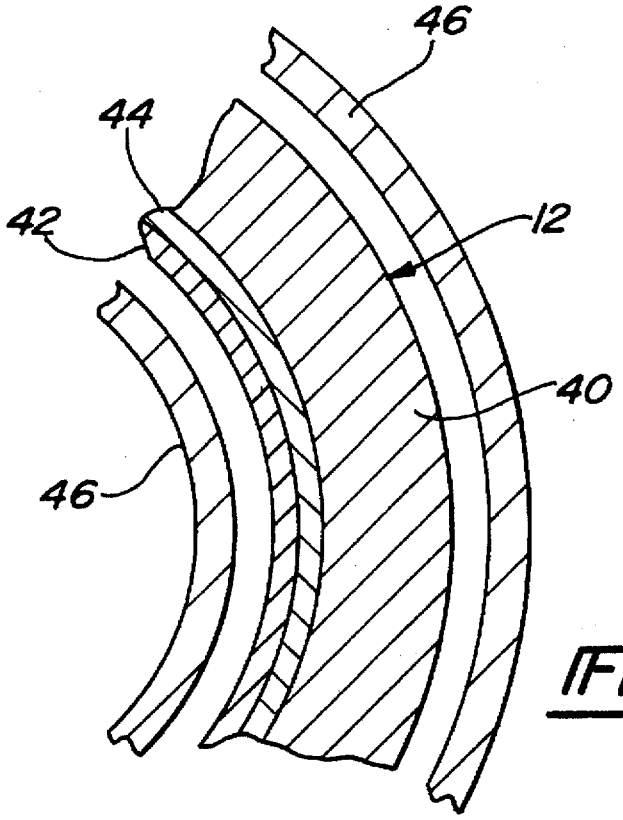
FIG. 3 is a sectional illustration of a barrel as used in the present invention being formed with an outer shell material, a buffer material and a bonded (mechanically or physically) outer layer.

As seen in FIG. 3, the HIP bonding of the Nb-based alloy was more specifically carried out by placing the alloy 718 outer layer 40 in an iron can 46 with a sheet steel interface and the Nb-based alloy in powder form on the can surface. The can 46 was then pumped down under vacuum, sealed and HIPPED (hot isostatic alloy pressed) at 2,060° F. After HIPPING, the composite barrel was subjected to heat treating involving aging for ten hours at 1400° F., cooled to 1200° F. and held for twenty hours, and then air cooled. The bonding of the Nb-based alloy of the inner layer 42 to the alloy 718 outer barrel 40 proved to be good.

Another advantageous approach for constructing the barrel 12 involves the use of an alloy in constructing the outer layer 40 having a coefficient of expansion more closely matching that of the Nb-based alloy. In comparison to alloy 718, alloy 909 has a coefficient of expansion which is closer to that of the Nb-based alloy (See Table 3).

TABLE 3

Coefficient of Thermal Expansion at 1200° F.

| MATERIAL | CTE (in/°F. × $10^{-6}$) |
|---|---|
| Alloy 718 | 8.3 |
| Alloy 909 | 5.7 |
| Alloy 783 | 7.0 |
| Nb-alloy (TRIBOCOR) | 5.0 |

Figure 4:
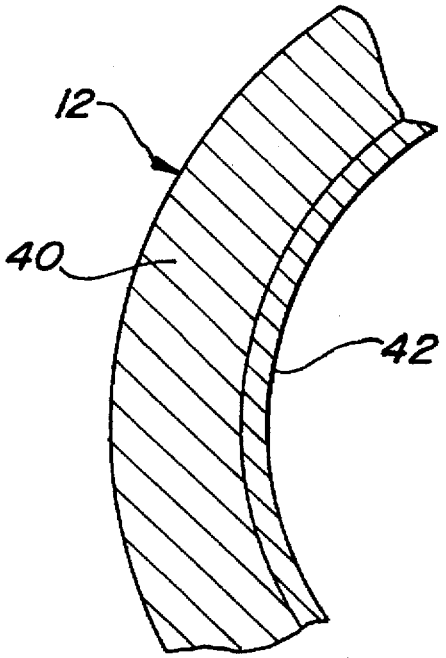
FIG. 4 is a sectional illustration of a barrel as used in the present invention being formed with a shell layer and a mechanically bonded inner layer.

In one attempt to bond the Nb-based alloy directly to an alloy 909 outer layer 40 of the barrel, direct HIPPING of loose Nb-based alloy powder did not result in the bonding of the Nb-based alloy to the inner diameter of the outer layer 40. It is therefore believed that a bending layer could be utilized as discussed above. However, because of the relative coefficients of thermal expansion between alloy 909 and the Nb-alloy, it is also believed that a liner 42 of the Nb-alloy can be shrunk fit into the outer layer 40 utilizing the slightly higher coefficient of thermal expansion of alloy 909 to place the Nb-alloy liner 42 in compression. Such a barrel 12 is illustrated in FIG. 4.

Nitriding of the Nb-alloy liner 42 is done prior to shrink fitting and is done to advantageously create a hard surface over a tough core, the outer layer 40. This provides the optimum wear resistance, corrosion resistance and erosion resistance while retaining the necessary toughness to resist impact and thermal cycling in the apparatus. Additionally, the nitriding can be carried out on monolithic Nb-alloy parts components (as discussed below), on the liner 42 after shrink fitting or on the HIP bonded liner 42. Conditions for nitriding the Nb-alloy are set out in Table 4.

TABLE 4

| Nitriding Nb-alloy at 1950° F. | | | |
|---|---|---|---|
| TIME | NITROGEN WEIGHT GAIN | DEPTH OF NITRIDE LAYER | |
| (hr) | mg/cm² | mils and microns | |
| 2.5 | 1 | 0.44 | 11 |
| 10 | 2 | 0.88 | 22 |

For barrels of small size, a monolithic construction of Nb-alloy could be utilized.

Figure 5:
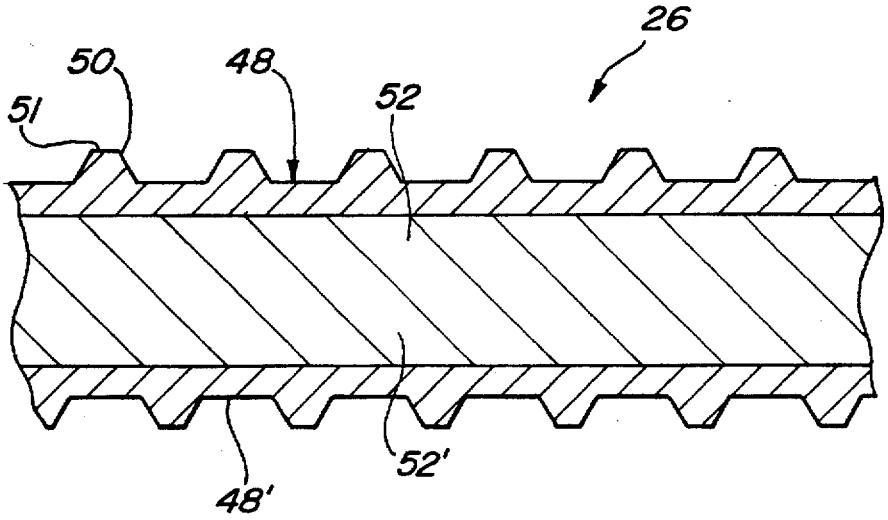
FIG. 5 is a sectional illustration of a screw constructed according to the principles of the present invention.

The internal screw 26 for the apparatus 10 can be fabricated as a monolithic Nb-alloy structure with the vanes 50 having flat tips 51 machined into the structure; as having a mechanical (e.g. keyed or screwed) sheath 48 (with vanes 50) attached to an alloy 718, an alloy 909 or a tool steel core 52 (as seen in FIG. 5); or HIP bonding an Nb-alloy layer 48 to a core 52 having the vanes 50 machined thereinto. Preferably, for creep resistance and thermal cycling resistance, the Nb-alloy is HIP bonded on an alloy 909 core 52 or 52.

Good creep strength characteristics at 1200° F. are a prerequisite for the apparatus' barrel 12 and screw 26. From the above, it has been discovered that alloy 718 or alloy 909 are preferable for forming the core of these load bearing components of the apparatus 10 since their stress-rupture strengths are about 30,000 psi for a 10,000 hour useful life at 1200° F., quite superior to tool steels. Yield strengths for alloy 718 and alloy 909 at 1200° F. are respectively 140,000 psi and 125,000 psi.

Figure 6:
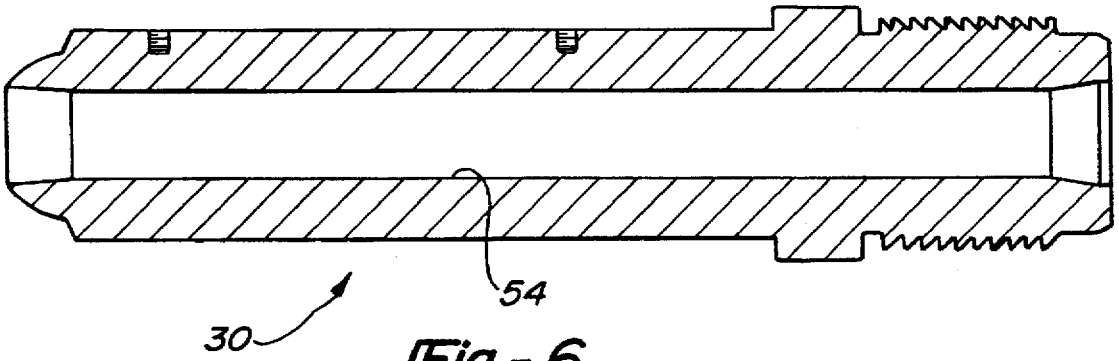
FIG. 6 is a sectional illustration of a nozzle constructed according to the principles of the present invention.

A monolithic Nb-alloy (Nb-30Ti-20W) nozzle 30 (seen in FIG. 6) and valves 38 were also successfully constructed and tested, both nitrided and non-nitrided versions, and put into simulated service at 650° C. for twenty to thirty hours. Upon reviewing cross-sections of the nozzles 30, it was found that no appreciable dissolution of the Nb-alloy occurred. Some minor reactions did occur between the nozzle 30 and the molten aluminum but these reactions predominantly appear to be an inward migration of silicon (the potline metal) into the nozzle 30 and the outward diffusion of tungsten into the melt. No diffusions of aluminum into the Nb-alloy on the internal passageway 54 of the nozzle 30 were found. These trends were found to be the same for both nitrided and non-nitrided nozzles 30 and this discovery led the present inventors to conclude that the Nb-alloy could withstand the rigors of processing corrosive and erosive molten materials.

Figure 7:
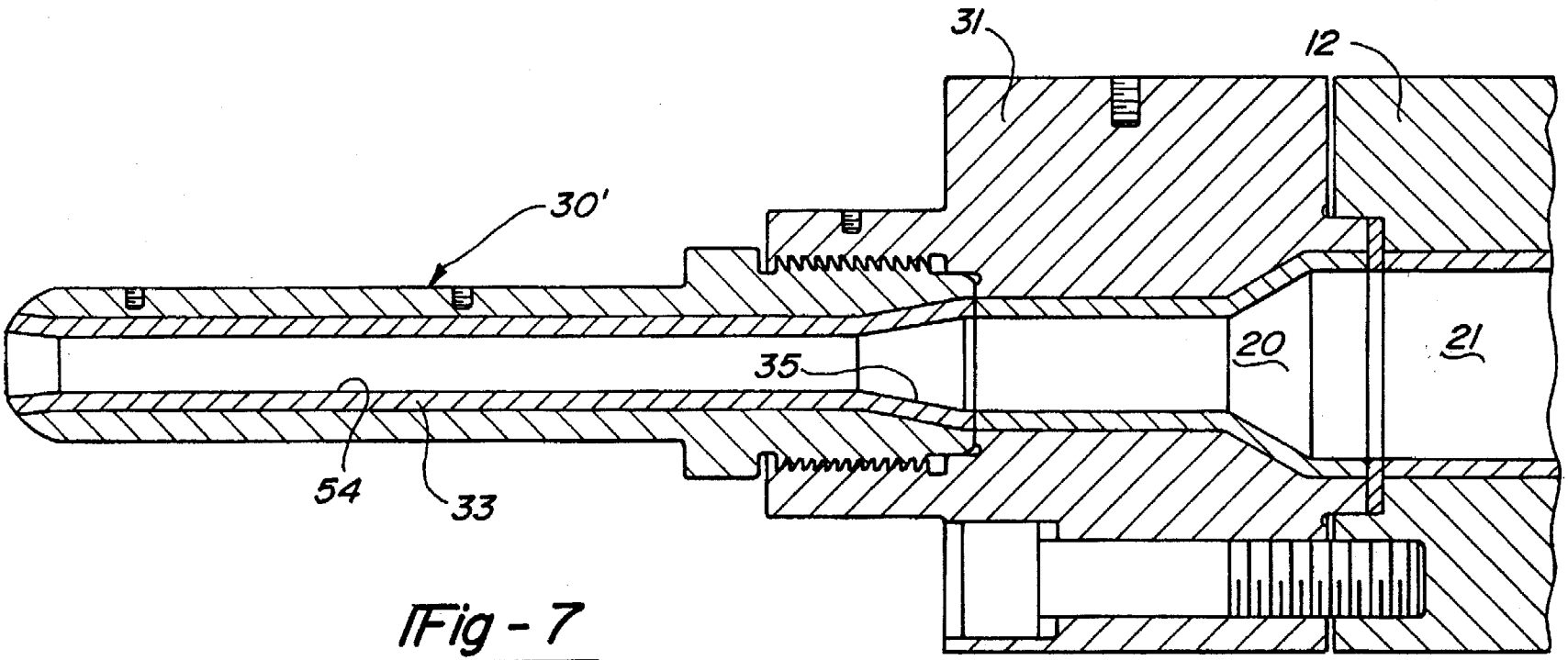
FIG. 7 is a sectional illustration of a second nozzle and barrel combination constructed according to the principles of the present invention.

As seen in FIG. 7, nozzles 30' and retainers 31 were also constructed such that liners 33 and 35 of Nb-alloy, produced by the various methods, resulted along the interior passageway 54.

An alternative alloy for use in forming monolithic components and/or HIPPED components, such as barrels, is a Nb-based matrix with a carbide hardening phase. As such, the Nb-based matrix can be alloyed with Ti, W, Mo, Ta or other elements which will strengthen Nb at room and high temperatures while retaining high corrosion resistance to melts or semi-solids of Al, Mg and Zn. The carbide phase is of a sufficient volume percent to impart hardness at both room and high temperature, but is also very fine, as imparted by powder metallurgy, so as to not degrade toughness. Preferably the carbide will be WC, TiC, NbC, TaC, or alloyed carbides of the aforementioned carbides. It is anticipated that other hard carbides, as well as hard borides, could also be used.

One preferred alloy composition of the above type has a matrix composition of 45 Nb (with other elements from above) and a carbide content of 10–50% by volume of WC, which is widely commercially available as a carbide. The preferred methods of processing the above alloy matrix compositions to form suitable components for the processing of highly corrosive semi-solid or molten metals include: 1) matrix powder atomization by gas or rotating electrodes; 2) blending with commercially available carbide powders such as WC or TiC; and 3) HIPPING. The alloy matrix composition could also be produced in a monolithic form or as a cladding for components in apparatuses for handling molten or semi-solid Al, Mg or Zn. Nitriding is not believed to be necessary.

While the above description constitutes the preferred embodiment of the present invention, it will be appreciated that the invention is susceptible to modification, variation and change without departing from the proper scope and fair meaning of the accompanying claims.

I claim:

1. Apparatus for processing a molten or semi-molten metallic material into a thixotropic state, said metallic material being corrosive when in a molten or semi-molten state, said apparatus comprising;

a barrel having opposing ends, said barrel having an outlet at one of said ends and having an inlet toward the other of said ends, said inlet located a distance from said outlet, said barrel having an inner surface of alloy Nb-30Ti-20W, said inner surface defining a passageway through said barrel and adapted to contact the metallic material as it passes through said apparatus, said inner surface being resistant to corrosion and erosion by metallic material and said passageway communicating said inlet with said outlet;

a screw located within said passageway for rotation relative thereto, said screw including a body having at least one vane thereon, said vane at least partially defining a helix around said body to propel the metallic material through said barrel, said screw having an outer surface being adapted to contact the metallic material as it passes through said apparatus and being resistant to corrosion and erosion by metallic material;

drive means for rotating said screw and shearing said metallic material at a rate sufficient to inhibit complete formation of dendritic structures therein while said metallic material is in a semi-molten state, rotation of said screw by said drive means further causing said metallic material to be discharged in a thixotropic state from said barrel and through said outlet for forming into a predetermined article;

feeder means for introducing said metallic material into said barrel through said inlet; and heating means for transferring heat to said barrel and said metallic material therein such that said metallic material is in a semi-molten state and at a temperature between the liquidus and solidus temperatures of said metallic material.

2. Apparatus for processing a molten or semi-molten metallic material into a thixotropic state, said metallic material being corrosive when in a molten or semi-molten state, said apparatus comprising;

a barrel having opposing ends, said barrel having an outlet at one of said ends and having an inlet toward the other of said ends, said inlet located a distance from said outlet, said barrel having an inner surface defining a passageway through said barrel and adapted to contact the metallic material as it passes through said apparatus, said inner surface being resistant to corrosion and erosion by metallic material and said passageway communicating said inlet with said outlet;

a screw located within said passageway for rotation relative thereto, said screw including a body having at least one vane thereon, said vane at least partially defining a helix around said body to propel the metallic material through said barrel, said screw including an outer surface of alloy Nb-30Ti-20W, said outer surface being adapted to contact the metallic material as it passes through said apparatus and being resistant to corrosion and erosion by metallic material;

drive means for rotating said screw and shearing said metallic material at a rate sufficient to inhibit complete formation of dendritic structures therein while said metallic material is in a semi-molten state, rotation of said screw by said drive means further causing said metallic material to be discharged in a thixotropic state from said barrel and through said outlet for forming into a predetermined article;

feeder means for including said metallic material into said barrel through said inlet; and heating means for transferring heat to said barrel and said metallic material therein such that said metallic material is in a semi-molten state and at a temperature between the liquidus and solidus temperatures of said metallic material.

3. Apparatus for processing a molten or semi-molten metallic material into a thixotropic state, said metallic material being corrosive when in a molten or semi-molten state, said apparatus comprising;

a barrel having opposing ends, said barrel having an outlet at one of said ends and having an inlet toward the other of said ends, said inlet located a distance from said outlet, said barrel having an inner surface of alloy Nb-30Ti-20W, said inner surface defining a passageway through said barrel and adapted to contact the metallic material as it passes through said apparatus, said inner surface being resistant to corrosion and erosion by metallic material and said passageway communicating said inlet with said outlet;

a screw located within said passageway for rotation relative thereto, said screw including a body having at least one vane thereon, said vane at least partially defining a helix around said body to propel the metallic material through said barrel, said screw including an outer surface of alloy Nb-30Ti-20W, said outer surface being adapted to contact the metallic material as it passes through said apparatus and being resistant to corrosion and erosion by metallic material;

drive means for rotating said screw and shearing said metallic material at a rate sufficient to inhibit complete formation of dendritic structures therein while said metallic material is in a semi-molten state, rotation of said screw by said drive means further causing said metallic material to be discharged in a thixotropic state from said barrel and through said outlet for forming into a predetermined article;

feeder means for introducing said metallic material into said barrel through said inlet; and heating means for transferring heat to said barrel and said metallic material therein such that said metallic material is in a semi-molten state and at a temperature between the liquidus and solidus temperatures of said metallic material.

4. An apparatus as set forth in claim 3 further comprising a nozzle for discharging said metallic material from said apparatus, said nozzle having surfaces in contact with said metallic material of alloy Nb-30Ti-20W.

5. An apparatus as set forth in claim 3 further comprising a non-return valve preventing back flowing of said metallic material during discharging thereof, said non-return valve having surfaces in contact with said metallic material of alloy Nb-30Ti-20W.

6. An apparatus as set forth in claim 3 wherein the apparatus further comprises a nozzle in said outlet, said nozzle having an interior surface defining a passageway therethrough, said interior surface being formed of alloy Nb-30Ti-20W.

7. An apparatus as set forth in claim 3 wherein all surfaces of said apparatus which contact the semi-molten state of said metallic material are formed of alloy Nb-30Ti-20W.

8. An apparatus as set forth in claim 3 wherein said inner surface of said barrel being a portion of an inner layer metallurgically bonded to said outer layer of said barrel.

9. An apparatus as set forth in claim 8 wherein said inner layer of said barrel is HIPPED to said outer layer of said barrel.

10. An apparatus as set forth in claim 8 wherein said outer layer of said barrel is alloy 718.

11. An apparatus as set forth in claim 10 wherein a bonding layer is positioned between said inner and outer layers of said barrel.

12. An apparatus as set forth in claim 8 wherein said inner layer of said barrel is mechanically bonded to said outer layer of said barrel.

13. An apparatus as set forth in claim 12 wherein said inner layer of said barrel is shrunk fit into said outer layer.

14. An apparatus as set forth in claim 12 wherein said outer layer of said barrel is alloy 909.

15. An apparatus as set forth in claim 3 wherein said outer surface of said screw being a portion of an outer layer which is metallurgically bonded to a core of said screw.

16. An apparatus as set forth in claim 15 wherein said outer layer of said screw is metallurgically bonded to said core by HIPPING.

17. An apparatus as set forth in claim 3 wherein said nozzle is of a monolithic construction of alloy Nb-30Ti-20W.

18. An apparatus as set forth in claim 3 further comprising a shot sleeve adapted to receive said metallic material from said barrel, said shot sleeve having interior surfaces of alloy Nb-30Ti-20W defining a passageway therethrough.

19. An apparatus as set forth in claim 18 further comprising an injection mold for receiving said metallic material from said shot sleeve.

20. An apparatus as set forth in claim 18 further comprising a casting die for receiving said metallic material from said shot sleeve.

21. An apparatus as set forth in claim 3 wherein said inner surface of said barrel is nitrided.

22. An apparatus as set forth in claim 3 wherein said outer surface of said screw is nitrided.

23. An apparatus as set forth in claim 3 wherein said Nb-based alloy is an Nb-based matrix composition having a carbide hardening phase.

24. An apparatus as set forth in claim 23 wherein said Nb-based matrix composition has a carbide content within the range of 10–50% by volume.

25. An apparatus as set forth in claim 24 wherein said carbide is WC.

26. An apparatus a set forth in claim 15 wherein said core is constructed of alloy 909.

27. An apparatus as set forth in claim 3 wherein said outer surface of said barrel is borided.

28. An apparatus as set forth in claim 3 wherein said outer surface of said screw is borided.

* * * * *

UNITED STATES PATENT AND TRADEMARK OFFICE

CERTIFICATE OF CORRECTION

PATENT NO. : 5,711,366

DATED : January 27, 1998

INVENTOR(S) : John Mihelich and Raymond F. Decker

It is certified that error appears in the above-indentified patent and that said Letters Patent is hereby corrected as shown below:

In column 10, line 3, after "(about" delete "5° F" and insert -- 5/°F -- and after "(about" delete "8.3° F" and insert -- 8.3/°F --

In column 13, line 30, Claim 2, after "for" delete "including" and insert --introducing--.

Signed and Sealed this

Fifteenth Day of December, 1998

Bruce Lehman

*Attest:*

BRUCE LEHMAN

*Attesting Officer*

*Commissioner of Patents and Trademarks*